US008385571B2

(12) United States Patent
Barthel et al.

(10) Patent No.: US 8,385,571 B2
(45) Date of Patent: Feb. 26, 2013

(54) CIRCUIT FOR OPERATING A HEARING DEVICE AND HEARING DEVICE

(75) Inventors: Roland Barthel, Erlangen (DE); Robert Bäuml, Eckental (DE); Dirk Junius, Langensendelbach (DE); Maja Serman, Erlangen-Buckenhof (FR); Nadine Seubert, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 420 days.

(21) Appl. No.: 12/432,073

(22) Filed: Apr. 29, 2009

(65) Prior Publication Data

US 2009/0274327 A1 Nov. 5, 2009

(30) Foreign Application Priority Data

Apr. 30, 2008 (DE) ..... 10 2008 021 612

(51) Int. Cl.
*H04R 25/00* (2006.01)

(52) U.S. Cl. ..... 381/314; 381/312; 381/313; 381/328; 381/330

(58) Field of Classification Search ..... 381/23.1, 381/312–314
See application file for complete search history.

(56) References Cited

U.S. PATENT DOCUMENTS

| | | | | |
|---|---|---|---|---|
| 4,972,487 | A * | 11/1990 | Mangold et al. | 381/315 |
| 5,604,812 | A * | 2/1997 | Meyer | 381/314 |
| 6,366,677 | B1 * | 4/2002 | Sigwanz et al. | 381/314 |
| 7,324,651 | B2 * | 1/2008 | Roeck | 381/318 |
| 7,974,716 | B2 * | 7/2011 | Schumaier | 700/94 |
| 8,077,890 | B2 * | 12/2011 | Schumaier | 381/314 |
| 2003/0055635 | A1 * | 3/2003 | Bizjak | 704/225 |
| 2004/0057593 | A1 * | 3/2004 | Pedersen et al. | 381/321 |
| 2004/0141624 | A1 * | 7/2004 | Davis et al. | 381/73.1 |
| 2005/0008166 | A1 * | 1/2005 | Fischer et al. | 381/60 |
| 2005/0129262 | A1 * | 6/2005 | Dillon et al. | 381/312 |
| 2007/0049788 | A1 * | 3/2007 | Kalinowski et al. | 600/23 |
| 2008/0165978 | A1 * | 7/2008 | Cronin et al. | 381/58 |
| 2008/0267435 | A1 * | 10/2008 | Schumaier | 381/314 |
| 2009/0245539 | A1 * | 10/2009 | Vaudrey et al. | 381/109 |
| 2010/0158262 | A1 * | 6/2010 | Schumaier et al. | 381/60 |
| 2010/0202637 | A1 * | 8/2010 | Cornelisse et al. | 381/314 |
| 2011/0150256 | A1 * | 6/2011 | Baechler et al. | 381/316 |

FOREIGN PATENT DOCUMENTS

| | | | |
|---|---|---|---|
| DE | 19542961 | C1 | 5/1997 |
| DE | 102005043348 | A1 | 12/2006 |
| EP | 0917397 | A1 | 5/1999 |
| JP | 2007295324 | A | 8/2007 |

* cited by examiner

*Primary Examiner* — Fernando L Toledo
*Assistant Examiner* — Mohammed Shamsuzzaman

(57) ABSTRACT

A circuit for operating a hearing device with a variable operating parameter is disclosed. A storage device for storing operating parameter settings in a starting situation as well as in a target situation and a control unit, which implements a matching of the operating parameter according to a setting of the starting situation to the operating parameter settings of the target situation, is provided. Further, a connection device for connection to a control element and a data processing device for influencing the operating parameter by a user of the hearing device, is provided. The control unit performs the matching of the operating parameter with a minimal matching rate in time segments in which the operating parameter is often influenced by the control element or data processing device, and with a higher matching rate in time segments, in which the operating parameter is rarely influenced or not influenced at all by the control element or data processing device.

4 Claims, 1 Drawing Sheet

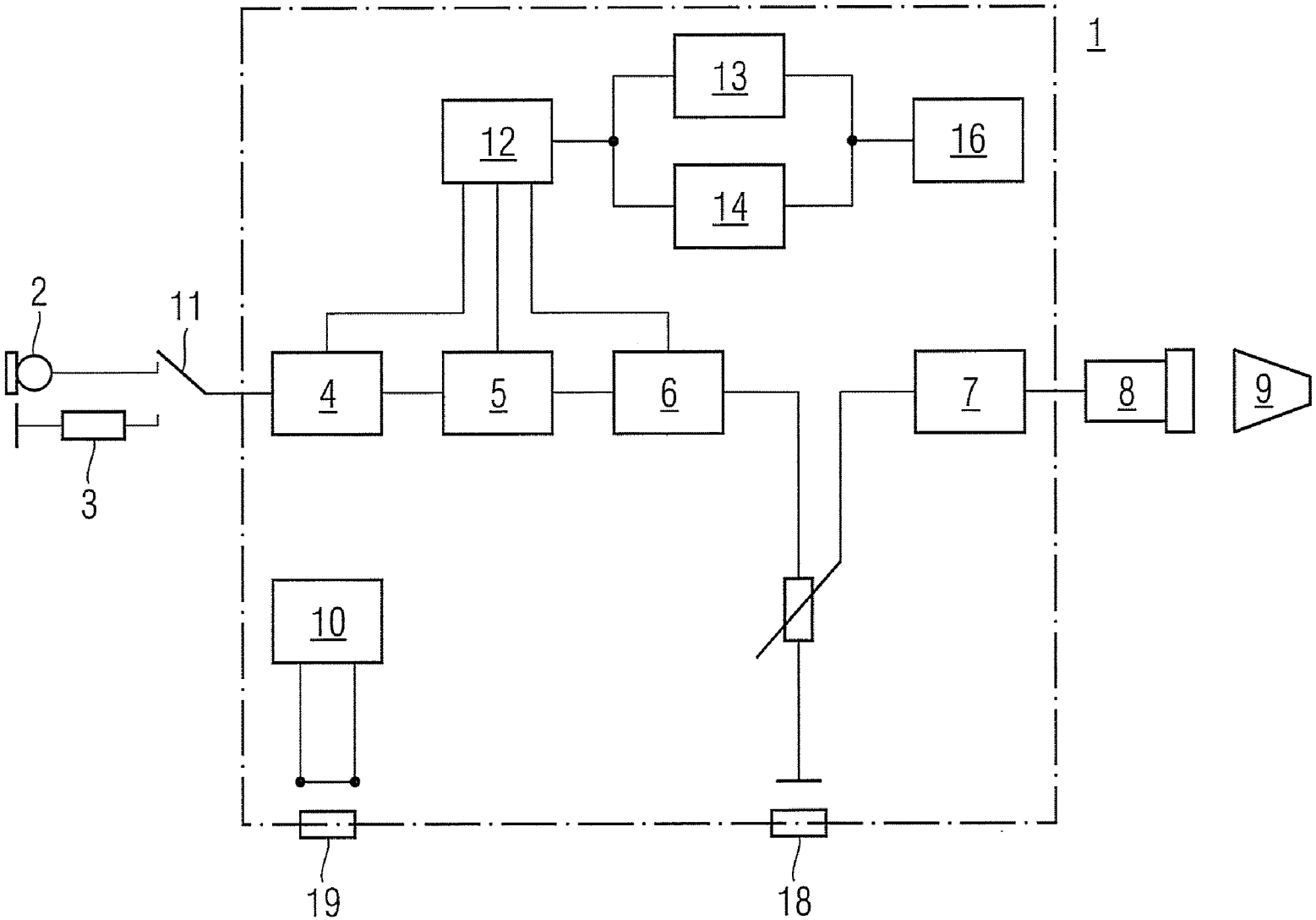
1
2
3
4
5
6
7
8
9
10
11
12
13
14
16
18
19

CIRCUIT FOR OPERATING A HEARING DEVICE AND HEARING DEVICE

CROSS REFERENCE TO RELATED APPLICATIONS

This application claims priority of German Patent Application No. 10 2008 021 612.7. DE filed Apr. 30, 2008. which is incorporated by reference herein in its entirety.

FIELD OF INVENTION

The invention relates to a circuit for operating a hearing device and a hearing device.

BACKGROUND OF INVENTION

Hearing devices are technical aids, which ameliorate congenital or hereditary hearing function impairments which are not amenable to causal therapy. Hearing devices amplify and modulate the sound, in other words the acoustic signal, upstream of the actual sense organ of the ear, the inner ear. Hearing devices consists here of one or several microphones, an electronic circuit, which has at least one analog or digital amplifier and one or several loudspeakers as well as an energy source for supplying these components.

A hearing device acoustician individually determines the audiometric characteristics of the ear for each patient and, with the aid of this, performs the optimal setting of the operating parameter(s) of the hearing device. Optimum speech intelligibility is generally aimed for here. The damaged hearing is however in many instances particularly sensitive to increased output levels. If the damaged hearing is provided with a hearing device which is adjusted for optimum speech intelligibility, the patient perceives this to be uncomfortable and will in some circumstances not use the hearing device.

The patent application DE 195 42 961. discloses a hearing device with a control unit, which, during a certain time interval, performs the adjustment of the operating parameters of the hearing device from a starting situation which is pleasant for the patient towards a target situation which is determined by the hearing device acoustician to be optimal. This adjustment process, also referred to as "training", provides the hearing device wearer with a pleasant introduction into the use of the hearing device which is new to him/her.

SUMMARY OF INVENTION

Modern hearing devices nevertheless provide the hearing device wearer with a series of possible influences, with which the hearing device wearer can on his/her part adjust the operating parameters of the hearing device to his/her wishes and requirements. This influence can however run contrary to the objective of the training and in an extreme case can lead to the manual "correction" by means of the hearing device wearer once again canceling out and/or permanently disrupting the adjustment achieved by the training so that the object of the training is never achieved.

An object of the present invention consists in specifying an improved circuit for a hearing device, which performs hearing device training aiming at a target situation which is determined by the hearing device acoustician as optimal, said target situation not being influenced by, or influencing, (fine) adjustments performed by the hearing device wearer or by the hearing device acoustician.

This object is achieved by a circuit comprising a control unit, which implements the matching of the operating parameter(s) with a minimal matching rate in time segments, in which the operating parameters are often influenced by means of the control element and/or the data processing device, and with a higher matching rate in time segments, in which the operating parameters are rarely influenced or not influenced at all by means of the control element and/or data processing device.

The present invention also relates to a hearing device with a circuit of this type.

BRIEF DESCRIPTION OF THE DRAWING

Exemplary embodiments of the present invention are explained in more detail below in conjunction with a drawing:

FIG. 1 shows a schematic representation of a circuit of a hearing device.

DETAILED DESCRIPTION OF INVENTION

FIG. 1 shows a schematic representation of a circuit of a hearing device. The reference character 1 in FIG. 1 refers here to the hearing device in its entirety. It includes a microphone 2 and a listening coil 3, which can be connected in each instance to an amplifier module by means of an operating switch 11. The amplifier module includes a preamplifier 4, a compression circuit 5, for instance a so-called AGC (Automatic Gain Control) circuit with a specific threshold value as well as a specific compression ratio, as well as a sound filter 6.

Provision is also made for a final amplifier 7, which is connected to the receiver 8, as well as an ear mold piece 9. A battery 10 electrically powers the hearing device 1 by way of an on/off switch 19. The volume of the hearing device 1 can be adjusted via a volume controller 18. The controller 12 is connected to an input unit 16.

The hearing device 1 includes a control unit 12 which interacts with a storage device consisting of the memory 13 for an operating parameter setting of the starting situation as well as a memory 14 of the operating parameter setting of the target situation.

The operating parameters to be adjusted are preferably the extent of the preamplification, the extent of the compression ratio, of the threshold value and/or of the time constants of the compression circuit and/or the frequency bandwidth, which adjust the sound to the individual hearing ability and/or the maximum output level. The matching of the operating parameters can either take place individually or together.

The individual operating parameters are now adjusted as a function of the control activity expected or determined in a specific time segment.

The already explained volume controller 18, but also the sound regulator and/or program selector switch (not shown) can also be considered as control elements for instance, with which the hearing device wearer can adjust the tone output of the hearing device 1 to his/her requirements, as well as the input unit 16, which allows the recording of parameters from an external data processing device, for instance a PC, by a hearing device acoustician, who can perform the (fine) adjustment of the hearing device in this way.

If a large number of control processes affecting the sound and/or volume in a time segment is now registered by the controller 12, or a large number of such control processes takes place in a time segment, (for instance a hearing device wearer initially "plays" with all the functions of his/her new hearing device, after having received it), the matching of the operating parameters of the starting situation to the target situation is very slow, i.e. with a minimal matching rate. This is advantageous in that the hearing device wearer does not attempt to reverse matching steps perceived to be too intensive by counteracting them accordingly. On the other hand, the hearing device wearer is able to judge better whether a fine tuning performed by the hearing device acoustician is suitable or not if the matching process running at the same time does not give rise to significant changes.

A minimal matching rate can be achieved for instance by the time intervals, with which the matching steps are implemented, being selected longer than usual. A minimal matching rate can likewise be determined by the weighting, with which the matching process exerts influence on the operating parameters to be equalized, being reduced.

If by contrast a minimal number of control processes affecting the sound and/or the volume in a time segment is registered by the controller 12, or experience shows that only a few such control processes take place in a time segment, the matching of the operating parameters of the starting situation to the target situation takes place with a normal or increased matching rate. The normal matching rate is understood here to mean the matching rate which a conventional hearing device uses with a continual matching of the operating parameters of the starting situation to the target situation.

The invention claimed is:

1. A circuit for operating a hearing device as part of a training process for using the hearing device aimed at achieving, over a time interval, predetermined optimal settings for the device based on predetermined audiometric characteristics of a user, comprising:

a storage device configured to store operating parameter settings in a starting situation comprising initial settings and operating parameter settings for in a target situation comprising predetermined optimal settings as part of a training process for using the hearing device;

a control unit configured for adjusting operating parameters that control an output of the hearing device, wherein the control unit is configured to adjusts the operating parameters by a matching process, over a certain time interval as part of the training process, that matches the operating parameter settings of the starting situation to the operating parameter settings of the target situation over the certain time interval;

a data processing device in communication with the hearing device for providing an external input configured for further adjusting of the output of the hearing device over the certain time interval by additionally influencing the operating parameters that control the output of the hearing device;

wherein a rate of adjustment applied by the control unit in the training process from the starting situation to the target situation over the certain time interval is configured as a function control activity by the data processing device adjusting of the output of the hearing device by external inputs from the user over the certain time interval influencing the operating parameters, such that the control unit is configured to implements the matching process with a minimal matching rate that slows down the matching process as part of the training process during time segments in which the data processing device is often additionally influencing the operating parameter because of frequent control activity, and wherein the control unit is configured to implements the matching process with a higher matching rate that speeds up the matching process as part of the training process in time segments in which the data processing device is rarely or not additionally influencing the operating parameters because of infrequent or no control activity.

2. The circuit for operating a hearing device as claimed in claim 1, further comprising:

a control element configured for further adjusting of the output of the hearing device by additionally influencing the operating parameters by an external input from the user of the hearing device or a hearing device acoustician.

3. The circuit for operating a hearing device as claimed in claim 1, wherein the minimal matching rate is achieved by the control unit configured to match parameters with a minimal weighting being used.

4. The circuit for operating a hearing device as claimed in claim 1, wherein the minimal matching rate is achieved by the control unit configured to select larger time intervals between individual matching steps.

* * * * *

UNITED STATES PATENT AND TRADEMARK OFFICE

CERTIFICATE OF CORRECTION

PATENT NO. : 8,385,571 B2
APPLICATION NO. : 12/432073
DATED : February 26, 2013
INVENTOR(S) : Roland Barthel et al.

It is certified that error appears in the above-identified patent and that said Letters Patent is hereby corrected as shown below:

In the Claims

Claim 1, Column 3 lines 31-32, replace "a storage device configured to store operating parameter settings in a starting situation" with "a storage device configured to store operating parameter settings for a starting situation".

Claim 1, Column 3 line 38, replace "wherein the control unit is configured to adjusts" with "wherein the control unit is configured to adjust".

Claim 1, Column 4 lines 9-10, replace "target situation over the certain time interval is configured as a function control activity" with "target situation over the certain time interval is configured as a function of a control activity".

Claim 1, Column 4 line 21, replace "the control unit is configured to implements" with "the control unit is configured to implement".

Signed and Sealed this
Twenty-third Day of July, 2013

Teresa Stanek Rea
*Acting Director of the United States Patent and Trademark Office*